US007559122B2

(12) United States Patent
Schatzmann et al.

(10) Patent No.: US 7,559,122 B2
(45) Date of Patent: Jul. 14, 2009

(54) METHOD FOR FIXING A CLOTHING STRIP ON A FLAT ROD, CLOTHING CLIP AND PRESSING TOOL FOR MACHINING A CLOTHING CLIP

(76) Inventors: Hans-Peter Schatzmann, Kirchgasse 13, CH-8524, Uesslingen (CH); Jürg Ott, Weinsteig 214, CH-8200, Schaffhausen (CH)

( * ) Notice: Subject to any disclaimer, the term of this patent is extended or adjusted under 35 U.S.C. 154(b) by 0 days.

(21) Appl. No.: 11/664,401

(22) PCT Filed: Oct. 11, 2005

(86) PCT No.: PCT/CH2005/000595

§ 371 (c)(1),
(2), (4) Date: Jan. 30, 2008

(87) PCT Pub. No.: WO2006/039829

PCT Pub. Date: Apr. 20, 2006

(65) Prior Publication Data

US 2008/0307611 A1 Dec. 18, 2008

(30) Foreign Application Priority Data

Oct. 13, 2004 (CH) ..... 1689/04

(51) Int. Cl.
*D01G 15/12* (2006.01)

(52) U.S. Cl. ..... 19/113; 19/114

(58) Field of Classification Search ..... 19/113, 19/114

See application file for complete search history.

(56) References Cited

U.S. PATENT DOCUMENTS

| | | | | |
|---|---|---|---|---|
| 4,295,248 | A * | 10/1981 | Beneke et al. | 19/113 |
| 5,095,585 | A * | 3/1992 | Grimshaw et al. | 19/113 |
| 5,755,012 | A * | 5/1998 | Hollingsworth | 19/114 |
| 6,219,885 | B1 * | 4/2001 | Faas et al. | 19/98 |
| 6,687,958 | B2 * | 2/2004 | Wurst | 19/98 |
| 6,766,564 | B2 * | 7/2004 | Pferdmenges | 19/113 |
| 7,055,222 | B2 * | 6/2006 | Bischofberger et al. | 19/114 |

FOREIGN PATENT DOCUMENTS

| | | |
|---|---|---|
| DE | 103 23 359 A1 | 5/2002 |
| EP | A 0403111 | 12/1990 |

* cited by examiner

*Primary Examiner*—Shaun R Hurley
(74) *Attorney, Agent, or Firm*—Dority & Manning, P.A.

(57) ABSTRACT

A method is proposed for fixing a clothing strip on a base surface of a flat rod by means of at least one clothing clip which comprises a first terminal section for attachment to the flat rod and a second terminal section for attachment to the clothing strip. The method is characterised in that a central section of the at least one clothing provided between the first and the second terminal section is deformed directly before or after the clothing clip has been placed against the flat rod. A corresponding clothing clip and a corresponding pressing tool are furthermore proposed.

15 Claims, 3 Drawing Sheets

METHOD FOR FIXING A CLOTHING STRIP ON A FLAT ROD, CLOTHING CLIP AND PRESSING TOOL FOR MACHINING A CLOTHING CLIP

PRIORITY CLAIM

The present application is a §371 application from PCT/CH05/00595, filed Oct. 11, 2005.

TECHNICAL FIELD OF THE INVENTION

The invention relates to a method for fixing a clothing strip on a flat rod by means of at least one clothing clip which comprises a first terminal section for attachment to the flat rod and a second terminal section for attachment to the clothing strip. The invention further relates to a clothing clip for fixing a clothing strip on a base surface of a flat rod comprising a first terminal section for attachment to the flat rod and a second terminal section for attachment to the clothing strip. Finally, the invention relates to a pressing tool for deforming a central section of a clothing clip.

BACKGROUND OF THE INVENTION

In revolving flats of carding machines it is known to use so-called clothing strips, on the underside whereof a plurality of clothing needles are fixed in the form of wire hooks. Each clothing strip is fixed to respectively one flat rod by means of so-called clothing clips or clothing clamps, a plurality of flat rods being combined to form a revolving endless chain.

The clothing clips are usually made of metal and comprise a first terminal section for attachment to the flat rod and a second terminal section for attachment to the clothing strip. The general advantage of the clothing clip is that they simplify the attachment and exchange of the clothing strips on the flat rods. In this case, they make a positive and non-positive connection between the clothing strip and the flat rod. The clothing clips are usually used in pairs, so that one or more clothing clips one behind the other provides the corresponding holding force on both sides of the flat rod. The second terminal section usually has teeth which engage in the clothing strips. These teeth thereby make a positive connection with the clothing strip. The first terminal section is further bent when drawing on the clothing and thereby clips around the corresponding part of the flat rod.

Numerous solutions for fixing said clothing clips using expensive assembly tools and/or trained specialist staff are known. These procedures are complex and costly.

It is the object of the present invention to ensure that the clothing clip can be attached and removed simply whilst retaining good holding force. In particular, simple handling by less trained staff should be possible according to the invention.

This object is achieved in a method for fixing a clothing strip on a base surface of a flat rod by means of at least one clothing clip which comprises a first terminal section for attachment to the flat rod and a second terminal section for attachment to the clothing strip, whereby a central section of the at least one clothing clip provided between the first and the second terminal section, is deformed directly before or after the clothing clip has been placed against the flat rod; in a clothing clip for fixing a clothing strip on a base surface of a flat rod comprising a first terminal section for attachment to the flat rod and a second terminal section for attachment to the clothing strip, whereby a central section provided between the first and the second terminal section which is configured in such a manner that it can be deformed, at least in sections, directly before or during placement of the clothing clip against the flat rod; and in a pressing tool for deforming a central section of a clothing clip, whereby the tool comprises at least one pressing strip or a mandrel, which is used to form or further develop a deformation zone in the central section.

The advantages of the invention are in particular that the central section of the clothing clip is deformed to produce the holding force and thereby clamps the clothing strip to the flat rod. Various possibilities for clamping the clothing clip are feasible. The clothing clip can, for example, be slightly deformed in its central section before drawing on and then brought to the final shape through the action of force or energy.

According to a first aspect of the invention, the holding force of the clothing clip can be produced or increased by the formation or further development of a zone located between the two terminal sections, in the central section. Without such a zone, the very large forces known from the prior art would be required for bending the first terminal section of the clothing clip which would require complex and therefore expensive tools which could only be handled by trained specialist staff. Such known tools are frequently operated with compressed air. The invention helps here since relatively weak forces are required to produce or further develop a deformation. In this case, the pressing tool according to the invention deforms the central section in order to produce the required holding force or if a deformation is already present, to further develop this whilst the first and/or the second terminal section of the clothing clip preferably rest against the flat rod or clothing strip in their final position. Such a tool requires little specialist knowledge to operate so that the spinning mill operator can have the clothing strips exchanged by their own staff.

According to said first aspect of the invention, it is particularly advantageous if the central section is deformed in such a manner that this zone comes to rest in a recess of the flat rod. Consequently, the central section can be embodied as rectilinearly flat prior to the plastic deformation, which is advantageous in the production of clothing clips. Only the second terminal section for clamping the clothing strip, and advantageously also the first terminal section, are already bent or formed so that they are offset before the central section is deformed or further deformed according to the invention.

Particularly preferably, the deformation zone lies freely in the recess of the flat rod after the pressing-in. By suitably selecting the pressing-in depth of the clothing clip, the operator of the pressing tool himself is accordingly put in a position where he can select how strong the degree of deformation of the clothing clip with the flat rod should be.

The afore-mentioned hand press which is independent of a fixed compressed air network or other supply lines is preferably operated by means of a built-in pneumatic or hydraulic system or purely mechanically. It is also feasible to have a unit which has a combination of the afore-mentioned operating modes or an operating mode not specified further. The pressing tool is furthermore preferably constructed in such a manner that it can not only be used for producing or further developing a deformation zone but also for fixing or creating the first and/or the second terminal section of the clothing clip on the flat rod or clothing strip. Naturally it is also feasible to use dedicated tools for this purpose but it is advantageous to allocate this double function to the pressing tool (hand press). In particular, the high force required from the prior art for bending the first terminal section need not be applied by the pressing tool since the deformation of the central sections then provides the final clamping.

The pressing tool according to the invention preferably has at least two opposing pressing strips or mandrels which can be aligned with respect to one another or moved towards one another. This configuration makes it possible to deform simultaneously two clothing clips arranged opposite to one another on both sides of a flat rod in order to produce the required holding forces for the clothing clips. In a simpler variant, the pressing tool is merely designed to form a deformation zone on a single clothing clip. It must then be used singly on both sides of the flat rod for each clothing clip.

The pressing tool which preferably has the length of the flat rods to which the clothing clips are fastened, is preferably U-shaped. It can then be delivered to the flat rod and the clothing strip to be arranged at its base surface from below and/or from the side. In the working position, the base leg of the pressing tool is arranged adjacent to the clothing strip. So that the base leg does not damage the clothing needles, preferably at least two elevations directed towards the clothing strip, preferably in the form of webs, are provided on the base leg, their height being at least slightly larger than the length of the clothing needles.

The pressing strips or the mandrels of the pressing tool according to the invention in the U-shaped embodiment are preferably each provided in the two side legs. In this case, the pressing strips or mandrels are each arranged opposite the two recesses of the flat rod.

The aforesaid double function of the pressing tool can be realised if the pressing tool has at least two opposite bending cheeks for creating the first terminal sections of the clothing clips at the U-shaped ends of the device. These bending cheeks are particularly preferably used for creating the first terminal section of the clothing clip before producing the deformation according to the invention to achieve the required holding force. For this purpose, the bending cheeks can be pivotally arranged, for example, at the U-shaped ends of the device. In an alternative, the elements producing the bending are embodied as clamping arms capable of translational movement, whereby they create the first terminal section of the clothing clip by a longitudinal advance.

The bending cheeks can preferably be locked in the end position, i.e. after creating the first terminal sections of the clothing clips so that the first terminal sections cannot bend again during the formation of the deformation zone according to the invention for producing the holding force. The second terminal section is preferably firmly inserted in the clothing strip.

Preferably, the same pressing tool as was used for fastening is used to release the at least one clothing clip after the clothing needle tips have worn. Appropriately in this case, the bending cheeks are brought from their clamping position into a release position in order to more strongly deform the respective central section by means of the mandrels or pressing strips, whereby the first terminal sections of the clothing clips open until they can be released from the flat rod manually or, for example, using tongs. Accordingly, the pressing tool according to the invention can take on another function.

According to a second aspect of the invention, the clothing clip according to the invention has at least one central section made of a bimetal whose different expansion properties at different temperatures is used. For this purpose, during application of the clothing clip, the central section is brought to a temperature at which the clothing clip can be simply placed on the flat rod or clothing strip. If the temperature of the bimetal then changes to the stand or operating temperature of the relevant textile machine, the bimetal of the central section contracts and provides the holding force of the clothing clip on the flat rod.

In a particularly preferred embodiment of this method according to the invention, the temperature on application of the clothing clip is raised compared with the operating temperature by means of a hot air device, or similar, so that the preferably convexly (relative to the flat rod) formed central section opens out and the clothing clip can then be brought into its rest position on the flat rod. The bimetal section can then be cooled so that this can again contract into its clamping position and thus the clothing strip is held firmly by means of the clothing clip on the flat rod.

Preferably before pulling on the clothing, the second terminal section of the clothing clip is anchored with its toothed structure in the clothing strip so that during or shortly after heating the bimetal strip, the upper end of the clothing clip can be pivoted towards the flat rod before then contracting during cooling and thereby producing the necessary holding force.

The corresponding clothing clip according to the second aspect of the invention preferably consists of a plurality of separate partial sections, where preferably at least the first partial section is made of a bimetal. This bimetal partial section can preferably be brought into engagement with the flat rod. A second partial section of the clothing clip is preferably connected to the clothing strip in a suitable manner. The two partial sections are preferably connected to one another by means of a detachable hook fastening or in some other suitable manner.

Accordingly, it is advantageous if the second partial section is initially anchored with its offset end in the clothing strip, then its other end is hooked to the first partial section and then the bimetal central section is heated. Then the entire clothing clip consisting of the two partial sections can be pivoted towards the flat rod, the free terminal section of the first partial section preferably embracing an undercut on the flat rod. After the bimetal has cooled, this contracts, whereby the clothing clip firmly clamps the clothing strip on the flat rod.

Advantageous further developments of the invention are characterised by the features of the dependent claims.

BRIEF DESCRIPTION OF THE DRAWINGS

The invention is explained in detail hereinafter with reference to the figures. In the figures.

DETAILED DESCRIPTION

Figure 1A:
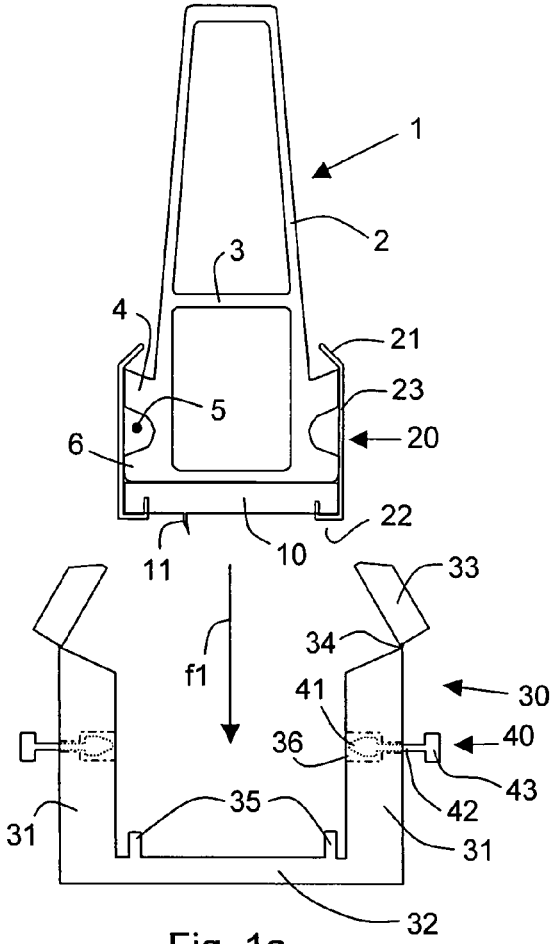
FIGS. 1*a*-1*d* show the various process steps for the attachment of a clothing clip according to the first aspect of the invention.

FIGS. 1*a*-1*d* each show a flat rod 1 with a clothing strip 10 applied to its underside in cross-section. Such a design is known, for example, from DE 103 23 359 A1. The flat rod 1 consists of a hollow profile 2 with a horizontal central web 3. Two projections 4, 6, each arranged under the other, are provided along both longitudinal sides of the flat rod 1, each forming a recess 5 between them. For simplicity, only one clothing needle 11 is shown in the clothing strip 10. It is understood that a plurality of such clothing needles 11 is provided on the underside of the clothing strip 10.

The flat rod 1 and clothing strip 10 are held together by means of clothing clips 20. According to the case shown in FIGS. 1*a*-1*d*, respectively one clothing clip 20 is provided on both sides of the flat rod 1 and the clothing strip 10 each clip being formed of a flat central section 23 and a first terminal section 21 and a second terminal section 22. The second terminal section 22 is bent in a U-shape and, according to the diagram in FIG. 1*a*, is anchored with its free end in the base material of the clothing strip 10. The slightly offset end of the first terminal section 21 points in the direction of the flat rod 1.

The lower half of FIG. 1*a*, also in cross-section, shows a pressing tool 30 according to the invention which in the present case has a U-shaped cross-section with a base leg 32 and two side legs 31. Two web-shaped elevations 35 are formed on the inside of the base leg 32. Two bending cheeks 33 which can each pivot about a pivot axis 34 are arranged at the free ends of the side legs 31.

Located approximately at the centre of each of the two side legs 31 is a pressing unit 40 consisting of a gripping portion 43, a shaft 42 and a pressing strip or mandrel 41. The pressing strips or mandrels 41 are facing one another and can be moved towards one another individually or synchronously so that they can be moved inwards beyond the inner sides of the side legs 31.

Figure 1B:
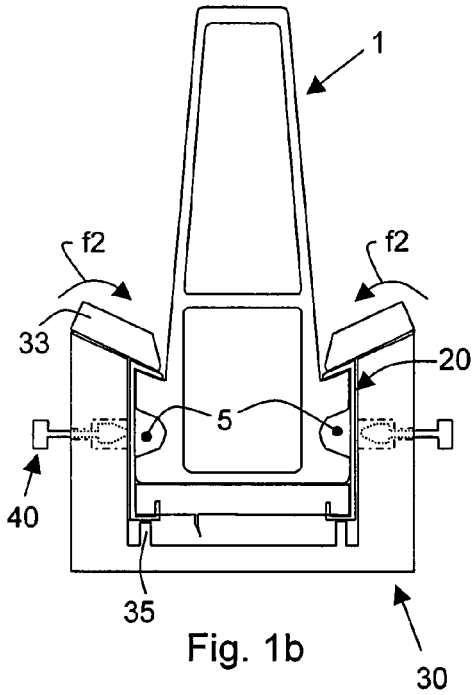
Figure 1C:
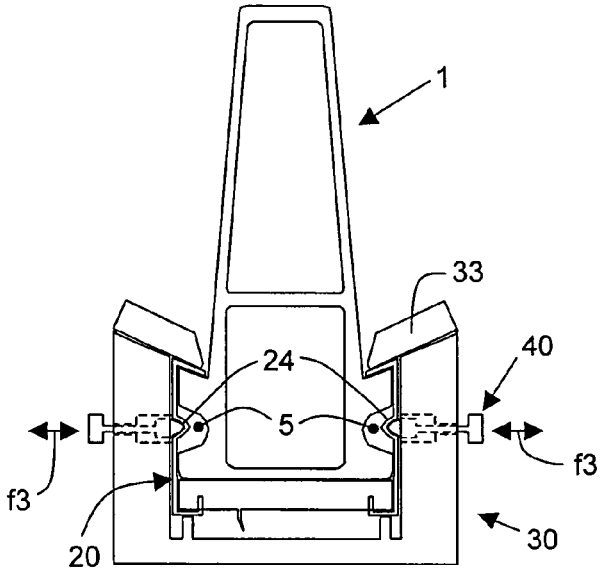

In FIG. 1*a*, the arrow f1 shows the direction of insertion of the flat rod 1 with clothing strip 10 and clothing clip 20 into the pressing tool 30. The flat rod can also be inserted longitudinally into the pressing tool. In FIG. 1*b* the pressing tool 30 is shown in its working position, wherein the two bending cheeks 33 are pivoted inwards in accordance with the arrow directions f2. The two first terminal sections 21 of the clothing clips 20 are thereby bent so that they abut against the upper sides of the projections 4. It can further be deduced from FIG. 1*b* that the two web-shaped elevations 35 keep the clothing needles 11 away from the base leg 32. In this way, the clothing needles 11 do not sustain any damage during the fixing of the clothing clips 20; in addition, the elevations 35 also serve as support for the second terminal section 22. For simplicity FIG. 1*b* does not show that the two bending cheeks 33 can be locked in the inward-pivoted position.

In said locking position, the pressing strips 41 can be advanced according to the directions shown by the arrows f3 (FIG. 1*c*) towards the central sections 23 of the clothing clip 20 in such a manner that these are deformed inwards into the recesses 5. In this way, deformation zones 24 produce holding forces that are formed approximately at the centre of the respective central sections 23, these zones 24 being located freely in the respective recesses 5. At the same time, it can be seen from FIG. 1*c* that the two terminal sections 22 are pressed more deeply into the clothing strips 10 as a result of the formation of the deformation zone 24. However, this is not necessarily the case; in an alternative, the second terminal sections 22 are already pressed into the clothing strips 10 as far as possible. Overall the procedure described according to the invention produces a very stable and reliable clamping by means of the clothing clips 20.

Figure 1D:
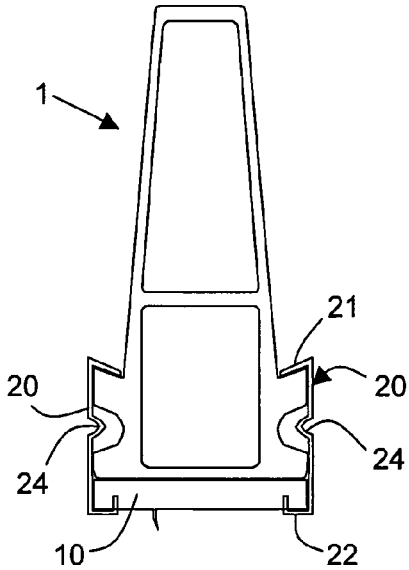
Figure 2:
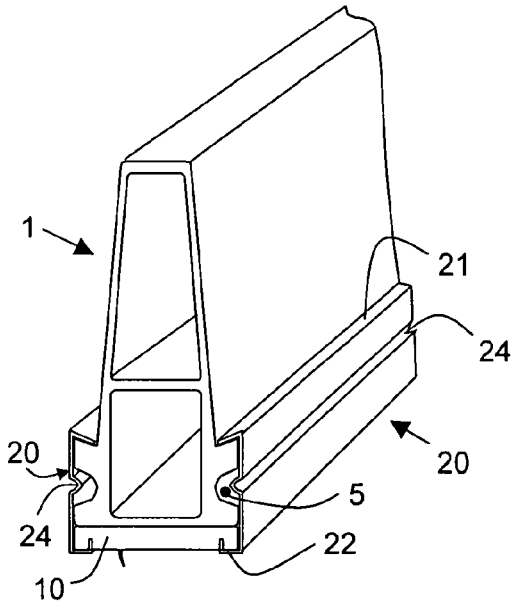
FIG. 2 is a perspective view of the flat rod, the clothing strip and the clothing clip according to FIG. 1*d;*

FIG. 1*d* shows the combination of flat rod 1, clothing strips 10 and clothing clip 20 after removing the pressing tool 30. For this purpose, the bending cheeks 33 were unlocked and pivoted upwards and the complete flat rod 1 was removed towards the front sides or upwards (opposite direction of movement to that in FIG. 1*a*). FIG. 2 shows a corresponding perspective view of the flat rod 1 with fixed clothing strip 10, where this is not shown over its entire length however.

Figure 3A:
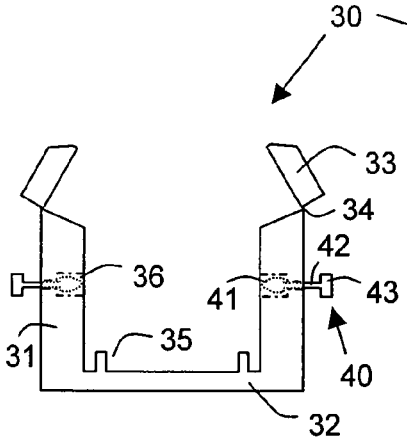
FIGS. 3*a*, 3*b* show the pressing tool according to the invention in side view and in plan view.
Figure 3B:
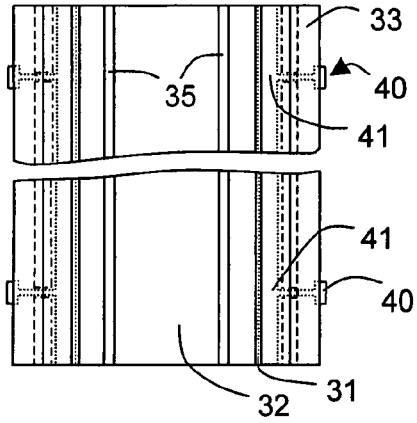

FIGS. 3*a* and 3*b* show the pressing tool 30 in cross-section (see also FIG. 1*a*) and in plan view. As can be seen from FIG. 3*b* in particular, the pressing strips 41 are each provided with a plurality of gripping portions 43 which are spaced apart along the tool so that the deformation zone 24 in the central section 23 can be produced with a high degree of uniformity over the entire length of the respective clothing clip 20. In an alternative embodiment not shown, instead of one pressing strip 41, a plurality of mandrels distributed over the length of the pressing tool 30 can be provided, each connected to its own gripping portion 43.

Figure 4:
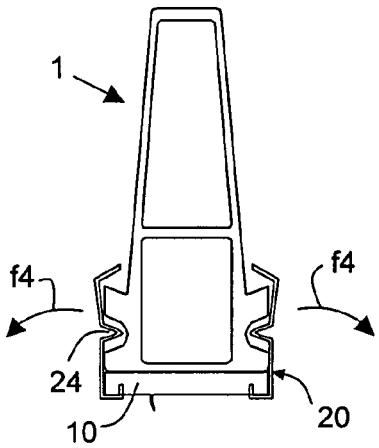
FIG. 4 shows a flat rod with released clothing clip.

FIG. 4 shows a flat rod 1 in which the pressing tool 30 according to FIGS. 3*a* and 3*b* has been used to release the clothing clip 20. In the same arrangement of the pressing tool as in FIGS. 1*b*, 1*c*, merely the bending cheeks 33 were pivoted upwards and the two pressing strips 41 were advanced further than that shown in FIG. 1*c*. When the upward-pivoted bending cheeks 33 are overpressed, the respective first terminal section 21 is released from the projection 4 of the flat rod 1, as shown in FIG. 4. The clothing clips can then be withdrawn from the flat rod 1 (see arrows f4).

Figure 5A:
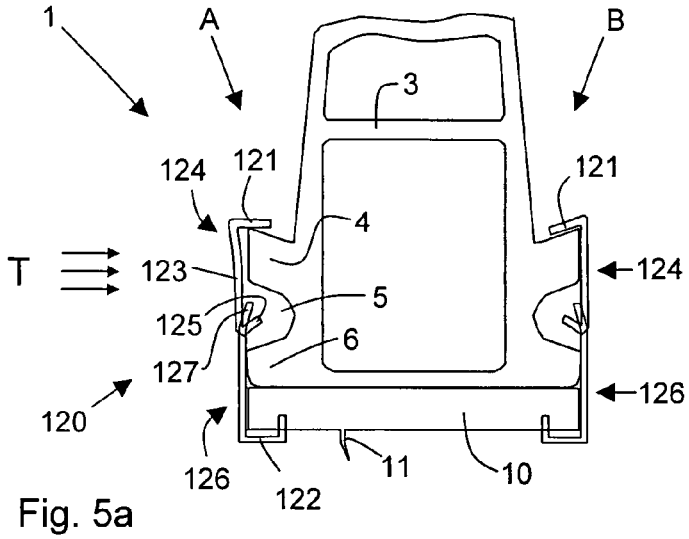
FIGS. 5*a*, 5*b* are side views of respectively one flat rod with different clothing clips according to the second aspect of the invention.
Figure 5B:
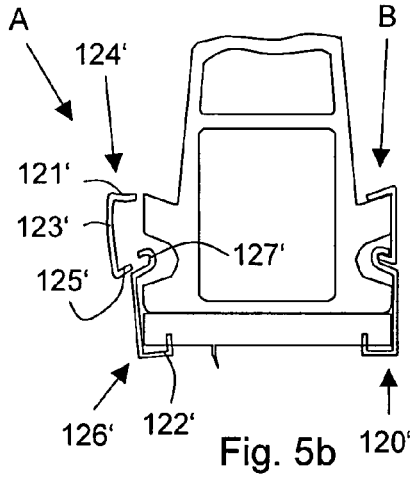

FIGS. 5*a*, 6*a* and 5*b*, 6*b* show two exemplary embodiments for a method or a clothing clip according to the second aspect of the invention. FIGS. 5*a* and 5*b* each show the lower portion of a flat rod 1 as well as a clothing strip 10 which are formed identically to the corresponding parts in FIGS. 1 and 2. The clothing clip 120 or 120' according to the invention according to the two embodiments in FIG. 5*a*, 6*a* or 5*b*, 6*b* on the other hand consists of respectively two partial sections 124, 126 or 124', 126', each intermeshing at their ends 125, 127 or 125', 127' which are facing one another and embodied as offset, to form a hook fastening.

Figure 6A:
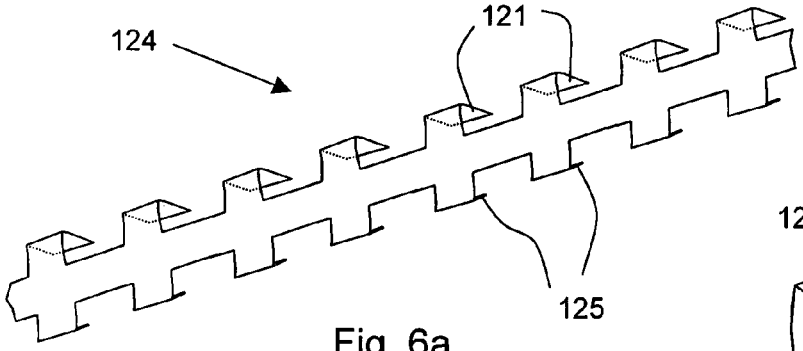
FIGS. 6*a*, 6*b* are perspective views of respectively one bimetal strip according to FIGS. 5*a*, 5*b
Figure 6B:
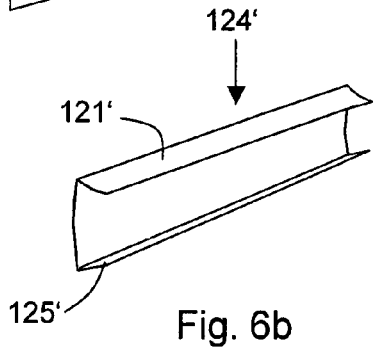

The difference between the two embodiments is that the ends 125, 127 or 125', 127' of the first and second partial sections 124, 126 or 124', 126', which are facing one another and are to be hooked to one another, are formed in one case with recesses between the offset sections (FIGS. 5*a*, 6*a*) and in one case as continuous (FIGS. 5*b*, 6*b*).

The respective free ends or terminal sections 121, 122 or 121', 122' of the partial sections 124, 126 or 124', 126' have the same function as the terminal sections 21, 22 of the clothing clip 20 according to FIGS. 1 and 2. Accordingly, the terminal section 122 or 122' of the partial section 126 or 126' is each anchored in the clothing strip 10 whilst the terminal section 121 or 121' of the partial section 124 or 124' embraces the undercut projection 4 of the flat rod 1.

The partial section 124 or 124' thus has the first terminal section 121 or 121' of the clothing clip 120 or 120' as well as a central section 123 or 123' pertaining to the clothing clip 120 or 120' which is deformed according to the second aspect of the invention, as described hereinafter.

Whilst the clothing clip 20 according to FIGS. 1 and 2 is preferably made of metal, for the embodiments according to FIGS. 5*a* and 5*b* this preferably only applies to the partial section 126 or 126'. The partial section 124 or 124' on the other hand is made entirely of a bimetal. Accordingly, the central section 123 or 123' is also made of this bimetal. At normal room temperature, the terminal section 121 (slightly convexly arched here) or 121' (slightly concavely arched here) of the partial sections 124 or 124' can only just be slid over the projection 4. This state "A" is shown in each case in the left half of the diagram in FIGS. 5*a* and 5*b*. When the bimetal is heated by means of a hot air device or similar (see the three horizontal arrows with the letter "T" as an indication of the increase in temperature), the arching of the central section 123 or 123' is reduced and the partial section 124 or 124' broadens. In this state of the bimetal, the partial section 124 or 124' can be pressed against the projection 4 in such a manner that the terminal section 121 or 121' embraces the projection 4 and after cooling the bimetal, a positive or non-positive connection is formed between flat rod 1, clothing strip 10 and clothing clip 120, see state "B" in the respective right half of the diagram.

For removal of the clothing clips 120 or 120' it is merely necessary to heat the central section 123 or 123', whereby this arches again, becomes released from the projection 4 and the partial section 124 or 124' can be removed in this position.

The construction described according to the second aspect has the advantage that the upper partial section 124 or 124' can be used many times.

FIGS. 6*a* and 6*b* each show a partial section 124 or 124' in perspective view which extends over the length of the flat rod 1, assuming this to be continued. According to the embodiment in FIG. 6*a*, terminal sections 121 are provided at equal distances whilst offset ends 125 provided for the hook fastening with the lower partial section 126 are arranged along the underside. In this embodiment of the partial section 124 it is possible to provide the partial section 126 (not shown in a corresponding perspective view) with a corresponding portion 127 which can optionally have openings for this purpose in which the offset ends 125 can be hooked. In the embodiment according to FIG. 6*b* on the other hand, the first and second terminal sections 121', 122' are embodied as continuous.

Figure 7:
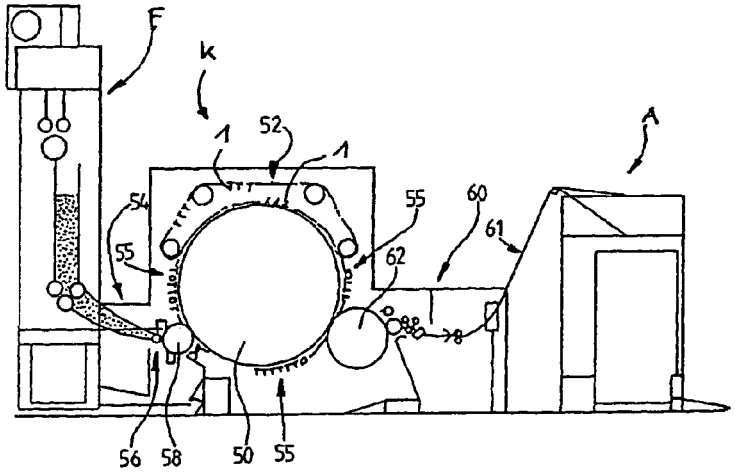
* and FIG. 7 is a schematic side view of a carding machine.

FIG. 7 shows a known carding machine K where flock from a filling box F is fed to a feed roller 56 and a subsequent licker-in 58. The carding machine K comprises a single main cylinder 56 (the so-called cylinder or drum) which is held rotatably in a frame. The cylinder 50 operates in a known manner with a revolving flat arrangement 52, a fibre feed system 54 which in particular comprises the feed roller 56 and the licker-in 58, and a fibre doffing system 60, comprising in particular a so-called doffing cylinder 62. Rod-shaped elements 55 can be attached in the pre-carding, re-carding and under-carding zones of the carding machine K. The fibre doffing system 60 conveys the sliver 61 to the sliver depositing system A.

Flat rods 1 are provided on the known revolving flat arrangement 52, only single rods 1 being shown schematically in FIG. 3. Revolving flat arrangements 52 commonly in use today comprise a plurality of flat rods 1. The flat rods 1 are carried in the vicinity of their respective front sides by endless strips and are moved towards the direction of rotation of the main cylinder 50. According to the invention, a carding machine K has clothing clips 20 or 120 or 120 or 120' according to the above description.

The invention has been explained in detail with reference to exemplary embodiments. Modifications within the scope of the claims or combinations thereof also come under the invention. For example, it is feasible that a plurality of clothing clips according to the invention are arranged along respectively one flat rod. Furthermore, according to the second embodiment, the clothing clip 120 or 120' can be constructed in one part.

The invention claimed is:

1. A method for fixing a clothing strip on a base surface of a flat, the method comprising steps of:

providing a clothing clip comprising a first terminal section for attachment to the flat, a second terminal section for attachment to the clothing strip, and a central section located between the first terminal section and the second terminal section; and deforming the central section of the clothing clip either before or after the clothing clip has been placed against the flat.

2. A method for fixing a clothing strip on a base surface of a flat as in claim 1, wherein said deforming step comprises modifying the central section of the clothing clip by depressing the central section and forming a deformation zone in the central section so as to create a holding force.

3. A method for fixing a clothing strip on a base surface of a flat as in claim 2, further comprising the step of providing a recess in the flat, wherein the central section is depressed into the recess in the area of the deformation zone.

4. A method for fixing a clothing strip on a base surface of a flat as in claim 3, wherein the deformation zone resides in the recess without the flat contacting the central section in the area of the recess.

5. A method for fixing a clothing strip on a base surface of a flat as in claim 2, further comprising the step of bending the first terminal section so as to clamp the flat before said deforming step.

6. A method for fixing a clothing strip on a base surface of a flat as in claim 1, further comprising the step of providing the clothing clip with a bi-metallic section.

7. A method for fixing a clothing strip on a base surface of a flat as in claim 6, further comprising the step of varying the temperature of the clothing clip so as to modify the shape of the clothing clip in a manner that causes the clothing clip to clamp more loosely around the flat.

8. A method for fixing a clothing strip on a base surface of a flat as in claim 6, further comprising the step of varying the temperature of the clothing clip so as to modify the shape of the clothing clip in a manner that causes the clothing clip to clamp more tightly around the flat.

9. A method for fixing a clothing strip on a base surface of a flat as in claim 1, wherein the clothing clip is fastened to two opposing sides of the flat.

10. A device for use with a clothing strip and a carding machine, the device comprising a flat defining at least one recess along a side of said flat; and a clip for attachment to said flat, said clip comprising a first terminal section for connection to the flat, a second terminal section for attachment to the clothing strip, and a central section located between said first terminal section and said second terminal section;

wherein said central section defines a zone extending into the at least one recess of said flat.

11. A clothing clip for use with a clothing strip and a carding machine as in claim 10, wherein said clip further comprises at least one bi-metal section.

12. A clothing clip for use with a clothing strip and a carding machine as in claim 10, wherein the first terminal section of said clip is bent about said flat so as to clamp said clip to said flat.

13. A clothing clip for use with a clothing strip and a carding machine as in claim 10, further comprising a pressing tool for positioning about said clip, said pressing tool comprising a base leg and at least one side leg, wherein the side leg comprises a pressing element configured for contacting the central section of said clip.

14. A clothing clip for use with a clothing strip and a carding machine as in claim 13, wherein the side leg of said pressing tool includes a bending cheek located at the end of the leg and configured for pivoting about a pivot axis so as to bend the first terminal connection.

15. A device for use with a clothing strip and a carding machine, the device comprising a flat defining at least one recess along a side of said flat; and a clip for attachment to said flat, said clip comprising a first portion having a first terminal section and a central section, said first portion constructed from a bi-metal;

a second portion having a second terminal section;

wherein the first portion and the second portion are connected to each other and wherein the central section extends into the recess of said flat.

* * * * *